United States Patent [19]

Nandlal et al.

[11] Patent Number: 4,484,840

[45] Date of Patent: Nov. 27, 1984

[54] METHOD AND APPARATUS FOR INSTALLING ANODES ON STEEL PLATFORMS AT OFFSHORE LOCATIONS

[75] Inventors: Samlal Nandlal, Slidell; David P. McGuire, Gretna, both of La.

[73] Assignee: Shell Offshore Inc., Houston, Tex.

[21] Appl. No.: 536,807

[22] Filed: Sep. 28, 1983

[51] Int. Cl.[3] ..... E02B 17/00; C23F 13/00

[52] U.S. Cl. ..... 405/211; 204/147; 204/197; 405/195; 405/216

[58] Field of Search ..... 405/195, 203–208, 405/211, 216; 204/147, 196, 197; 114/222

[56] References Cited

U.S. PATENT DOCUMENTS

| | | | |
|---|---|---|---|
| 2,571,062 | 10/1951 | Robinson et al. | 204/197 |
| 2,870,079 | 1/1959 | McCall | 204/197 |
| 4,056,446 | 11/1977 | Vennett | 204/197 |
| 4,089,767 | 5/1978 | Sabins | 204/197 |
| 4,211,503 | 7/1980 | Peterson et al. | 405/216 |
| 4,285,615 | 8/1981 | Radd | 405/211 |
| 4,292,149 | 9/1981 | Warne | 204/147 |
| 4,415,293 | 11/1983 | Engel et al. | 405/211 X |

*Primary Examiner*—Dennis L. Taylor

[57] ABSTRACT

A method and apparatus for supplementing the substructure of an offshore platform within, or in the vicinity of, the well conductors of the platform so as to add large numbers of anodes distributed vertically within the platform adjacent the well conductors. A number of anodes are attached to the outer surface of a number of short sections of pipe. The pipe sections are lowered down through the platform where each section is anchored to a preselected cross-bracing platform member. These anode carrier sections are connected together under water to form an elongated tubular support for the anodes.

36 Claims, 16 Drawing Figures

FIG. 8
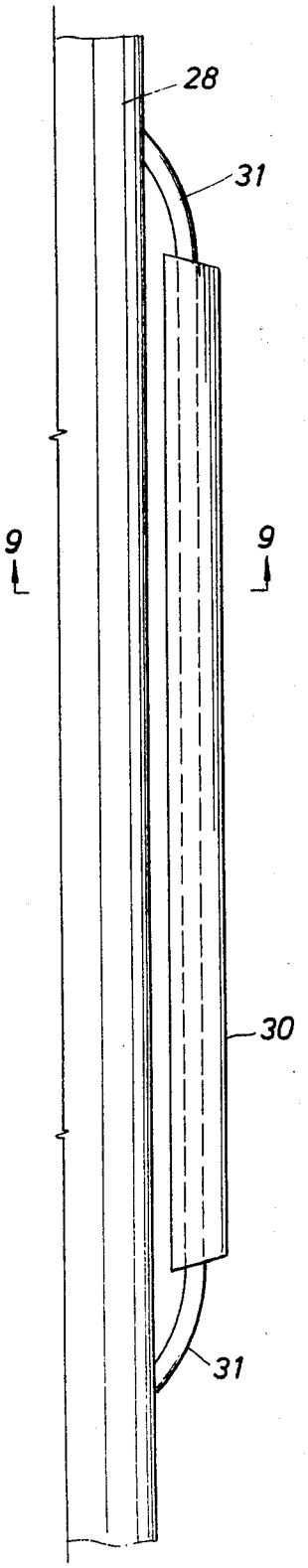
FIG. 10
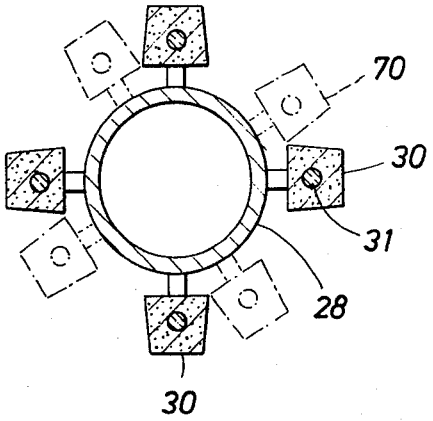
FIG. 13
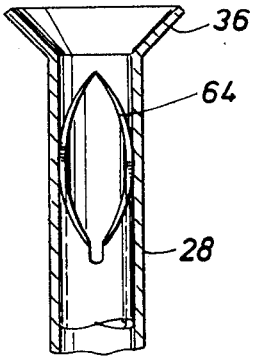
FIG. 14
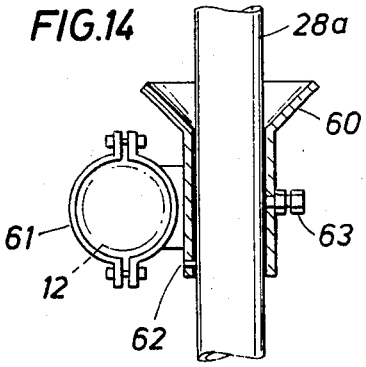
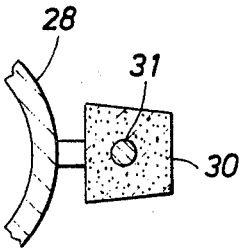
FIG. 9
FIG. 16
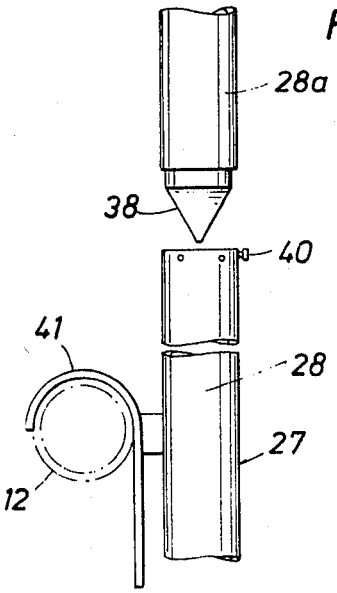

METHOD AND APPARATUS FOR INSTALLING ANODES ON STEEL PLATFORMS AT OFFSHORE LOCATIONS

BACKGROUND OF THE INVENTION

This invention relates to a method and apparatus for providing additional or replacement anodes to prevent corrosion of a steel platform positioned at an offshore location.

Present day offshore platforms used in the oil and gas industry are often formed of large-diameter pipe elements in the form of three or more vertical or slanting legs interconnected or reinforced by cross-bracing tubular members. Such bottom-supported platforms have been used in waters up to 1025 feet deep. The deepwater platforms may have more legs which may be tapered. For example, one deepwater platform off the California coast has eight legs that are made of 72 inch diameter pipe at the ocean floor and taper upwardly to 48 inch diameter pipe at sea level. Cross-bracing members are mostly 36 or 42 inches in diameter. In addition, the platform is provided with sixty 24 inch diameter vertical pipes, risers or well conductors which are grouped near the center of the platform and through which individual wells are drilled. Further, the platform supports vertical pipe risers through which oil and gas may be separately pumped down to an ocean floor pipeline and thence to shore.

In order to protect the present offshore platforms from corrosion in sea water, the structural members of the platform are provided with a cathodic protection system which comprises fixedly securing to a plurality of the structural members a number of sacrificial anodes which are preferably made of aluminum, zinc, or an alloy of these and/or other metals, in a manner well known to the art. Anodes are often used which are made of magnesium which gives out a larger current than aluminum alloy anodes, although having a shorter life, as disclosed in U.S. Pat. No. 2,571,062. In addition to anodes being fixedly mounted on a platform, they may be suspended therefrom by chains or cables as shown in U.S. Pat. Nos. 2,870,079; 4,089,767; 4,292,149; and 4,056,446.

Corrosion in sea water is an electrochemical process. During the chemical reaction of metals with the environment to form corrosion products (such as rust on steel), metallic atoms give up one or more electrons to become positively charged ions, and oxygen and water combine with the electrons to form negatively charged ions. The reactions occur at rates which result in no charge build-up. All the electrons given up by metal atoms must be consumed by another reaction.

The cathodic protection of offshore platforms and other structures exposed to marine environments in an art which has been practiced for many years. The objective of all anode systems is to provide current flow from anodes to a platform so as to elevate the polarization level of the platform within the "protected" range; that is, the level at which electron emission from the protected platform to the surrounding sea water is substantially inhibited, thereby suppressing corrosion of the platform.

Cathodic protection is a process which prevents the anodic corrosion reaction by creating an electric field at the surface of the metal so that current flows into the metal. This prevents the formation of metal ions by setting up a potential gradient at the surface which opposes the electric current which arises from the flow of electrically charged ions away from the surface as the product of corrosion. The electric field must be of adequate strength to ensure that metal ions are fully prevented from escaping.

A source of the electric field which opposes the corrosion reaction may be current supplied from the preferential corrosion of a metal anode with different electrochemical properties in the environment, and which has a stronger anodic reaction with the environment than does the offshore structure. Thus, current flows to the structure from the additional anode, which itself progressively corrodes in preference to the structures. This technique is known as sacrificial anode cathodic protection. This method is used extensively for the protection of offshore platforms, drilling rigs, submarine pipelines, etc.

When sacrificial system is chosen, the weight of material required to provide the protection current for the projected lifetime of the structure is calculated from a knowledge of the current demand and also the specific electrochemical properties of the anode alloys.

The calculated weight of anode alloy cannot be installed all in one piece but must be distributed over the structure in the form of smaller anodes to ensure uniform distribution of current. In order to select the best size and shape of anode, the total current demand of the structure both at the beginning and end of its life must be considered. The anode must deliver adquate current to polarize the structure and build up cathodic chalks, but also must be capable of delivering the required mean current for the structure when 90% consumed.

Thus, on most offshore platforms a multiplicity of anodes are arranged on the various structural members of the platform. These anodes are generally attached to the platform before the platform is lowered to the ocean floor. Generally, the well conductor pipes are not provided with anodes as the conductors are lowered through the deck and driven into the ocean floor after the platform is in position. It has been found that by installing numerous anodes on the structural elements of the platform in the vicinity of the well conductors that the conductors, which are welded at the top of the platform or are in electrical contact with the platform, are adequately protected against electrolytic corrosion in the sea water.

A major problem is encountered with a platform positioned over an offshore oil field with calculated life of twenty years at the time the field was first put into production. In actuality, the field proved to have a life of forty years or more. Thus, it may be seen that the cathode protection system for the platform is probably inadequate to protect the steel platform from sea water corrosion for this longer period. Hence, it is generally necessary to add additional anodes to the underwater portion of the platform structure. On small simple platforms in shallow water, it is sufficient to lower an anode down through the water on a hoist cable and have a diver connect it to its underwater position on the platform. However, the large deepwater platforms, containing a large number of well conductors, comprise a maze of vertical and cross-bracing members where oftentimes there are not a sufficient number of members located next to a cluster of well conductors, to which anodes can be secured to provide adequate protection for the well conductors.

SUMMARY OF THE INVENTION

It is an object of the present invention to provide a method and apparatus fo supplementing the substructure of an offshore platform within, or in the vicinity of, the well conductors of the platform so as to add large numbers of anodes distributed vertically within the platform adjacent the well conductors.

In the practice of this invention, a number of anodes, selected in number and composition, are attached to the outer surface of a number of short sections, say, 20 feet, of pipe. The pipe sections are transferred to a deck of an offshore steel platform where they are temporarily connected one at a time to a cable so that they may be lowered down through the platform where each section is anchored to a preselected cross-bracing platform member. These anode carrier sections are connected together underwater to form an elongated tubular support for the anodes, said support being generally known hereinafter as an "anode carrier apparatus" or "long anode apparatus". The anode carrier apparatus, when positioned in the substructure of the platform and electrically connected thereto, provides an effective way to add an auxiliary anode system to a platform without the need to employ divers to carry out underwater welding, or welding on deck, to attach large numbers of heavy anodes to the platform substructure. Additionally, in large platforms used in deep water, say, 1,000 feet, the cross-bracing members of a platform substructure may be 50 to 100 feet apart. As the anodes positioned to protect a group of closely-spaced well conductors may have an effective protective range of only about about 25 feet, the system of the present invention provides a method and apparatus for providing a rigidly-supported continuous and extended arrangement of anodes along a selected path within the platform that spans areas in which only widely-spaced cross-bracing members, are located. The auxiliary anode system of the present invention is generally positioned within 25 feet of the platform members, including well conductors, to be protected and generally extends from just below the surface of the body of water to the lowermost cross-bracing member of the platform substructure above the ocean floor.

BRIEF DESCRIPTION OF THE DRAWING

FIG. 6 is a schematic view of one anode carrier section cooperating with a lower section;

FIG. 8 is a longitudinal view of one form of an anode adapted to be secured to its tubular carrier body;

FIG. 9 is a cross-sectional view taken along the line 9—9 of FIG. 8;

FIG. 10 is a cross-sectional view of one arrangement of anodes positioned around a tubular carrier body;

FIG. 13 is a longitudinal view, taken in partial cross-section, of a bell guide element provided with orienting means;

FIG. 14 is an longitudinal view, taken in partial cross-section, of another form of anchoring means for the lower end of an anode carrier section;

FIG. 16 is a longitudinal view, illustrating another form of connector to prevent lateral movement between cooperating ends of two anode carrier sections.

DESCRIPTION OF A PREFERRED EMBODIMENT

Figure 1:
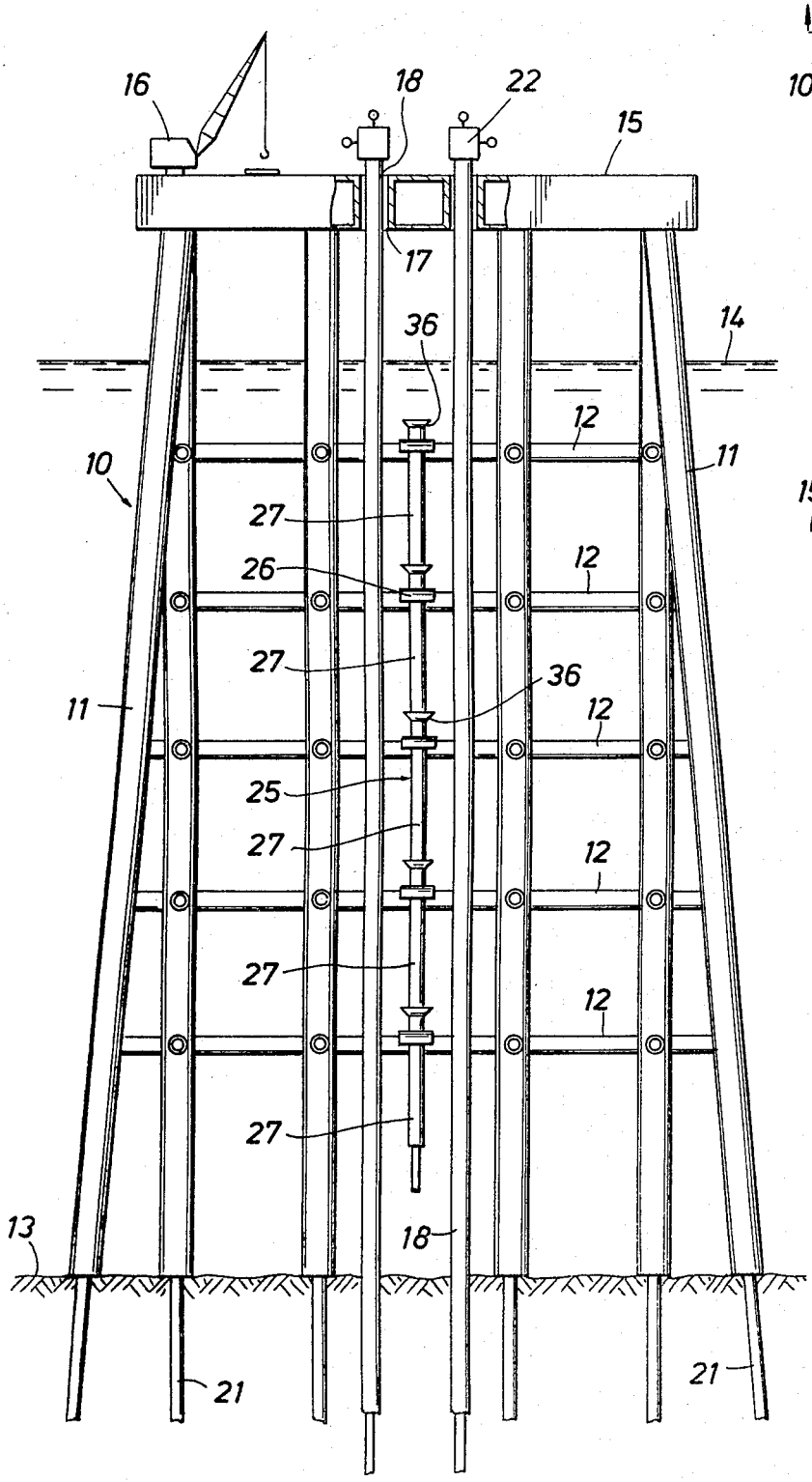
FIG. 1 is a diagrammatic view, taken in cross section, along line 1—1 of FIG. 2, of an offshore platform showing an arrangement of well conductors in the platform together with the apparatus of the present invention.
Figure 2:
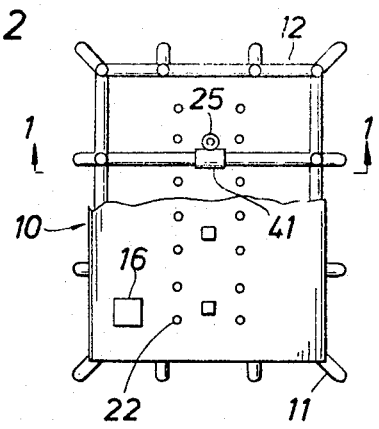
FIG. 2 is a plan view of the offshore platform of FIG. 1.
Figure 6:
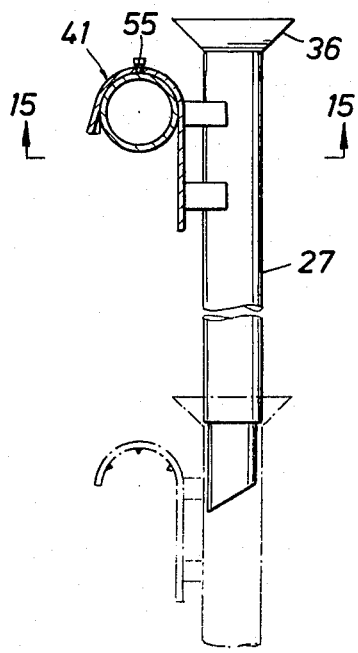
FIG. 6 is a schematic view illustrating two anode carrier sections connected in end-to-end relationship.

Referring to FIG. 1 of the drawing, an offshore platform is generally represented by numeral 10 which may comprise a plurality of elongated tubular legs 11, which are interconnected by any arrangement of cross-bracing members 12. The legs 11 extend substantially vertically from the sea bed or ocean floor 13 to a suitable level, say 50 feet, above the mean water line 14 where they support one or more operating and/or storage decks 15. The deck may be provided with at least one hoist unit 16 for handling pipe and other equipment on the platform.

The upper and lower floors of the deck 15 are provided with one or more wellbays or opening 17 therethrough which a well conductor 18 is passed at the start of well drilling operations. A well conductor 18 is generally heavy-walled pipe, say, 20 inches in diameter, which is made up of 30 or 40 foot sections of pipe which are welded or screw-threaded together, in a manner well known to the art, on the deck 15 of the platform 10 and then lowered through opening 17. A platform may have from 1 to 80 well conductors depending on the number of wells to be drilled.

The platform 10 is generally secured to the ocean floor 13 by driving piles 21 down through the tubular legs 11 into the ocean floor where they may be cemented in place. During the drilling of a well through a well conductor 18, one or more strings of casing and one or more tubing strings are run into the well and are hung from and/or supported by a wellhead 22 which closes the top of the well and conductor 18 during production operations.

In a typical well installation, a 20 inch diameter well conductor 18 is made up on the platform 10, section by section being connected together in end-to-end relationship, and lowered through the wellbay 17 and then down through the bell guides (not shown) to the ocean floor 13. Additional sections of pipe are secured to the top of the well conductor 18 as it is driven into the ocean floor 13, say to a depth of 250 feet, by the use of a pile driver in a manner well known to the art. Well drilling operations are carried out through the well conductor 18 down to, say, 2,000 feet. A string of casing, say 10¾ inches in diameter, is run into the hole, hung from the wellhead 22 and cemented in place. Well drilling operations are continued to, say, 10,000 feet and another string of casing is run into the well, hung from the wellhead 22 and cemented in place. This casing string may be 7 inches in diameter and may surround a 2½ inch tubing string.

It is general practice to protect an offshore platform against electrolytic corrosion either by equipping it with an impressed-current cathodic protection system or with sacrificial anodes, or by both. Even though such equipment is used, the environmental factors at a platform location may change over the years resulting in inadequate protection to well conductors on many of the platforms that have been in the water over ten years.

In view of the fact that the condition of the basic platform may be good and the oil and/or gas field may be produced for many more years, a method was developed for supplying to the platform additional protection againt corrosion caused by sea water. While it has been known to supply a platform with additional anodes by affixing the anodes to the platform substructure or the cross-bracing members thereof, as through the use of remotely-controlled underwater vehicle, it is often the case that there are not any platform cross-bracing members within the operative range, say, 25 feet, of that portion of the platform which most needs corrosion protection, namely, a cluster of well conductors.

One typical arrangement of wells on a platform deck 15 is shown in FIG. 1. In this case the platform is provided with two parallel lines of wells wherein the wellheads 22, and the well conductors extending downwardly therefrom. Since the vertical spacing between the platform cross-bracing members 12 (FIG. 1) may be in the order of from 70 to 90 feet in a large deepwater platform, it may be seen that parts of the well conductors would not receive any corrosion protection from anodes having a 25 foot effective range if the supplemental anodes being added to the platform were connected directly to the cross-bracing members 12.

Hence, the present method and apparatus were developed by which supplemental or auxiliary anodes could be fixedly secured to an elongated substantially rigid anode carrier member, which in turn would be made up of shorter anode carrier sections each of which could be hung on or secured to a cross-bracing member of a platform substructure in operative proximity to the platform well conductors to protect them from corrosion at least along the underwater length of the conductors.

Figure 4:
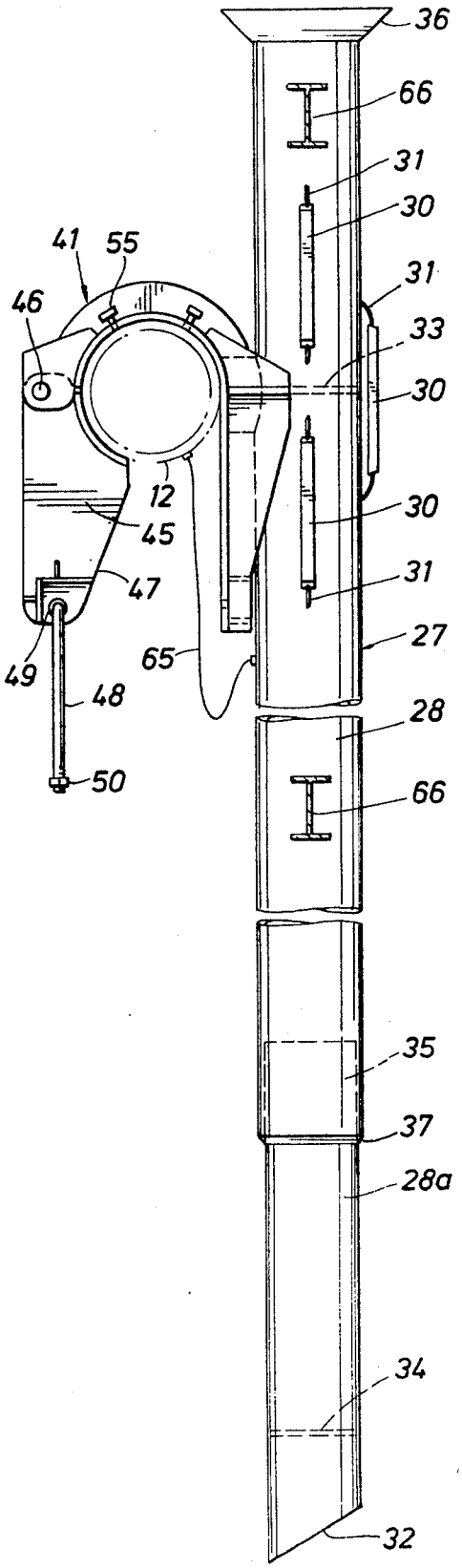
FIG. 4 is a longitudinal view of an anode carrier section used to make up a complete anode carrier apparatus of FIG. 5.

The anode carrier member or apparatus, generally represented by numeral 25 in FIG. 1 of the drawing, has anodes mounted thereon, as by welding, to the outer surface therof, as shown in FIG. 4. The anode carrier apparatus 25, which may be several hundred feet long, is made up of fabricated underwater on the substructure of the platform 10. The long anode carrier 25 is provided with means along its length for connecting it to or hanging it from the cross-bracing members 12 platform by any suitable weight-supporting means. In the embodiment illustrated, it is desired to hang the anode carrier apparatus 25 from a plurality of cross-bracing platform members 12 and this is accomplished by providing hangers 26. Each hanger 26 is secured, as latching, bolting, etc. near the upper end of each anode carrier section 27, as will be discussed in greater detail with regard to FIGS. 3,4, and 5.

The anode carrier apparatus 25 of the present invention is made up of a plurality of pipe sections of from 40 to 100 feet long and of any suitable diameter in wall thickness required to support the number and weight of anodes needed and to span the distance between two cross-bracing members 12 of the platform 10. For example, a typical anode carrier section 27 may be 90 feet long and made up of a length of pipe which is 18 inches in diameter and has a half inch wall thickness. As shown in FIG. 4 the upper major portion of the anode carrier section 27 comprises a pipe 28 of one diameter while a short section of pipe **28*a* is secured, as by welding or screw threading, to the lower end of the pipe section 28. The outer diameter of the short section of pipe 28*a* is less than the inner diameter of the main pipe section 28 so that the lower end of the anode carrier section may be stabbed into the top of the next lower anode carrier section making up the anode carrier apparatus 25. Arranged on the outer surface of the pipe section 28 are a plurality of anodes 30 which may be secured thereto by welding the core rod 31 that passes through the anode 30 to the outer surface of the pipe 28. Any suitable arrangement of the anodes and any number of anodes may be used depending upon the weight of anodes needed to give the necessary protection against corrosion. A typical anode is shown in FIG. 8 as comprising any elongated magnesium or aluminum alloy body which may be, say, 8 feet in length and have a cross-section of 6 to 10 inches (FIG. 9). The core of rod 31** extending from each end of the anode is generally made of steel so that it may be welded easily to a steel pipe.

Referring to FIG. 4, the lower end of each anode carrier section 27 may be tapered, as at 32, in order to facilitate stabbing into the upper end of the adjacent section 27 which is provided with suitable aligning means. One form of aligning means may take the form of a truncated cone guide welded to the open top of pipe section 28 for guiding the cooperating end of an adjacent anode carrier section 27 into axial alignment with the bell guide. When two sections are stabbed together, the lower end **28*a* is able to move into the upper end of the next adjacent section until a shoulder 37 seats on the top of the pipe 28 at the bottom of the bell guide 36. Alternatively, another aligning means may take the form of a downwardly directed cone or pointed end 38 which is welded to the small diameter lower end of pipe section 28*a* and which is adapted to enter and be seated on the upper end of the next lowermost anode carrier section 27**.

Thus it may be seen that two adjacent sections 27 of the anode carrier apparatus 25 are prevented from having any lateral movement by stabbing the upper end of one section into the lower section. Since the weight of each anode carrier section 27 may be 5,000 pounds, there is generally little chance of vertical movement of the sections. However, anchoring means against relative vertical movement of two sections may be provided if desired and may take any forms such, for example, as set screws or locking screws 40 which may extend through the wall of one pipe section 28, as shown in FIG. 16, and engage the outer wall of the pipe section stabbed into it. If set screws are used, any number may be used and their use is preferred so as to get a better electrical contact between the ends of two anode carrier sections.

Figure 5:
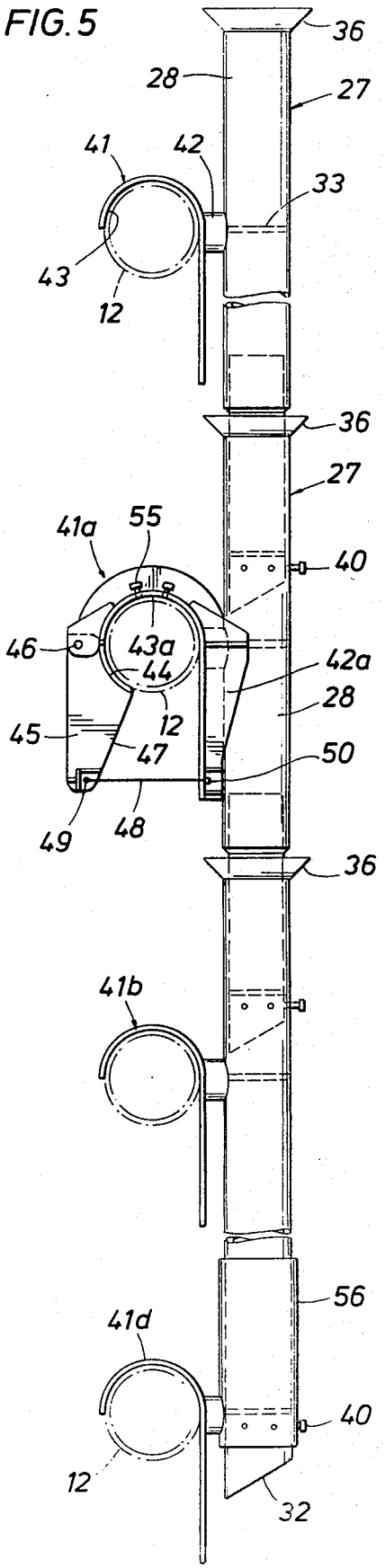
FIG. 5 is a longitudinal view of a complete anode carrier apparatus of the present invention wherein several anode carrier section of FIG. 4 are connected together, with the lowermost sections connected to the anode carrier section of FIG. 3.

In order to support each anode carrier section 27 on a cross-bracing member 12 of the platform, as shown in FIG. 5 each section is provided with a hanger 41 of any suitable design which may be welded directly to the upper pipe body 28 or may be offset therefrom and fixedly secured thereto by means of a suitable support element 42 which may be cylindrical in shape or may be in the form of gussets 42*a*. The hanger means 41 connected to the support element 42 may take the form of a horizontal pipe engaging saddle element 43 of a size and configuration to rest upon and cooperate with at least the upper surface of a cross-bracing member of the platform's substructure. Thus, the pipe-engaging saddle element may take the form of a short half section of pipe that has been cut longitudinally in two half sections. The inner diameter of the pipe forming the saddle element 43 is at least equal to that of the outer diameter of the cross-bracing member 12 on which it is to rest. The support means 42 fixedly secures the saddle element 43 to the anode carrier section 27 in the upper portion thereof and at an offset portion thereto. The offset distance of the longitudinal axis of the saddle element 43 is equal to at least the diameter of the platform cross-bracing member 12 on which the saddle element is seated. It is to be understood that the spacing between the several hanger means 41, 41*a*, and 41*b* along the length of the anode carrier apparatus 25 is substantially equal to the vertical spacing between the cross-bracing members 12 of the platform substructure on which the hanger means are to rest. Since it may be difficult to take a precise underwater measurement of the distance between two cross-bracing members 12 of the platform 10, and since one cross-bracing member relative to the other may have developed a sag in it from the time it was installed many years before, it may be seen that the telescoping fitting together of adjacent ends of two anode carrier section provides sufficient leeway to compensate for any change in spacing of the cross-bracing members over the years.

Another form of hanger means 41*a* is shown in FIG. 5 as including a hinged plate 44 which is mounted on an arm 45 which, in turn, is hinged to the saddle element 43*a* by means of a hinge pin 46. The inner face 47 of the arm 45 is tapered downwardly and outwardly so that the opening at the lower end of the arm is at least equal to the diameter of the cross-bracing member 12 so as to facilitate the stabbing of the hanger 41*a* over the cross-bracing member 12 when it is lowered into place thereon. It may be seen that when the saddle element 43*a* has seated itself on the cross-bracing member 12, the hinge plate 44 and its arm 45 will swing inwardly so that the hinge plate bears against at least a portion of the lower side of the member 12. The hinge plate 44 may be made of a short section of pipe that was used to make the saddle element 43*a* an hence to concave along its horizontal length with a diameter to mate with a portion of the lower half of the cross-bracing member 12. If desired, the hinge plate 44 and arm 45 may be rigidly locked in place or to the support member 42*a* by any suitable means. For example, a connecting rod 48 may be pivoted as at point 49 on the lower end of arm 45 and swung horizontally to engage the support member 42*a* where it is connected thereto as by a nut 50. This connection could either be made by a diver or by a remotely controlled vehicle.

Figure 7:
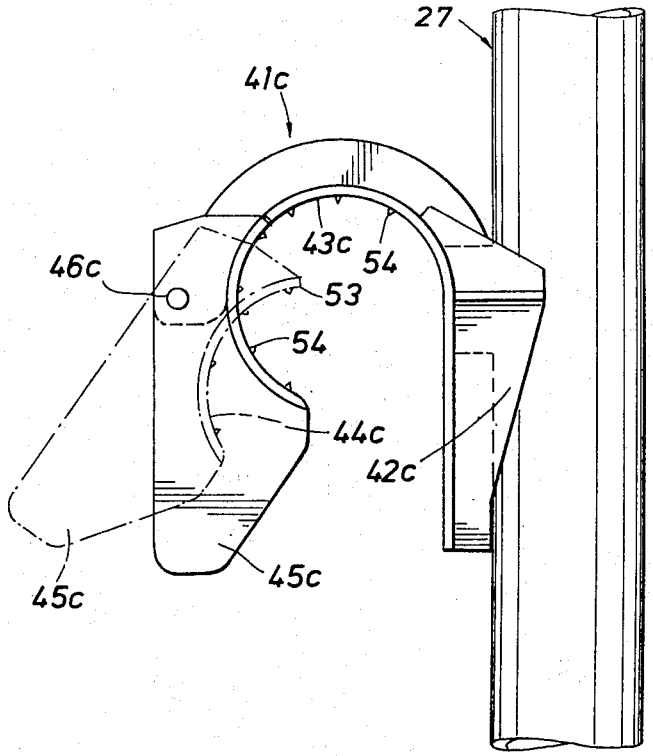
FIG. 7 is a longitudinal view of another form of a hanger for an anode carrier section.

Another form of a hanger 41*c* as shown in FIG. 7 as comprising a saddle element 43*c* having an arm 45*c* pivoted thereto by means of a hinge pin 47*c*. The arm 45*c* has an actuating arm section or extension 52 above the hinge pin 46*c*. When the arm 45*c* is it its operative position, it would open to the position shown in dotted lines in FIG. 7. However, when the hanger 41*c* was lowered down over a cross-bracing member the tip or leading edge 53 of the hinge plate 44*c* would come in contact and the arm 45*c* would be moved to the closed position shown in FIG. 7. At this time the cone shaped electrical contact elements 54 welded to the inner face of the hinge plate 44*c* and saddle element 43*c* would come in contact with the outer surface of the cross-bracing member and form an electrical contact therewith. Alternatively, the hanger element 43*a* and any of the other hanger elements can be provided with set screws 55 to form electrical contacts between the hanger element and the cross-bracing member on which it rests. The bearing of the set screws against the cross-bracing member could be adjusted by underwater divers or remotely-controlled underwater vehicles having an actuatable wrench head thereon, as is well known to the art.

Figure 3:
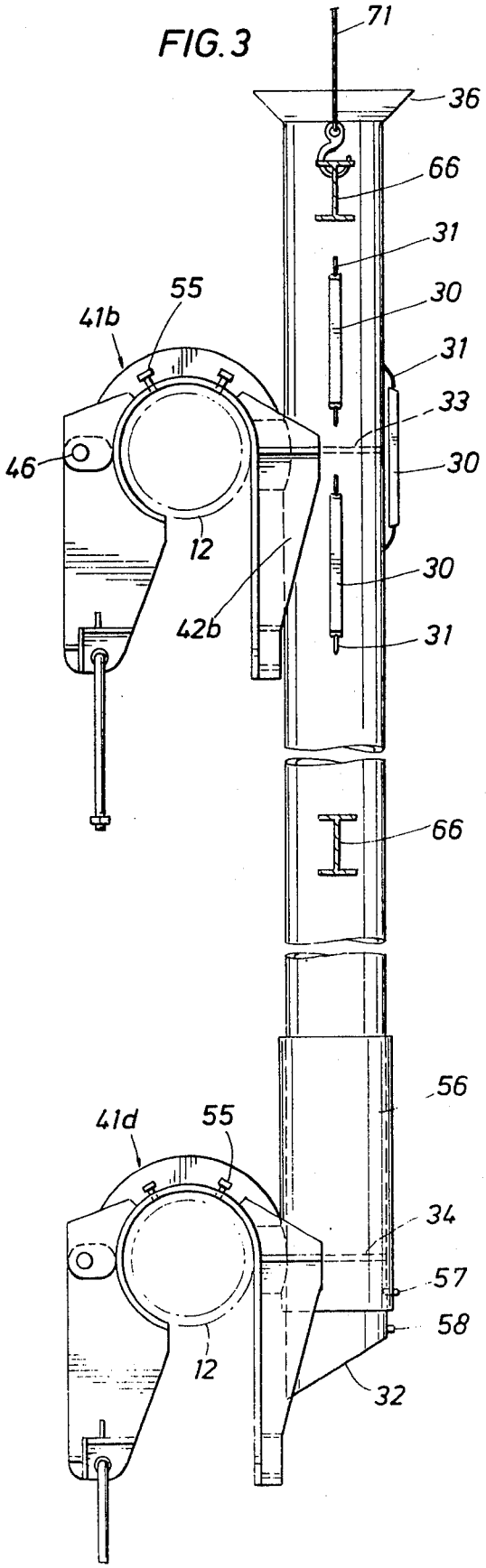
FIG. 3 is a longitudinal view of one form of an anode carrier section to be located as the bottom section of an anode carrier apparatus.

As shown in FIG. 1 of the drawing, the lower most anode carrier section 27 of the anode carrier apparatus 25 may be supported on the cross-bracing member 12 with its lower end hanging free. If the lower most section 27 is of substantial length, it is preferred to provide the lower end thereof with suitable connector means for securing the lower end of the lower most anode carrier section to a cross-bracing member of the platform and anchor it against lateral movement. FIG. 3 of the drawing illustrates an anode carrier section 27 with its hanger 41*b* identical to that described with regard to FIG. 5. The connector at the bottom of the anode carrier section 27 takes the form of a sleeve or short pipe section 56 mounted in coaxial relationship with the lower end of the section 27. Prior to installation, the sleeve is temporarily secured to the pipe 28 in any suitable manner so that it will not drop off the lower end thereof during the installation. For example, it could be supported by temporary cables, or could be fixedly secured thereto by a shear pin 57 which could be readily sheared by axial movement of the sleeve relative to the section 27 after the hanger 41*d* carried by the sleeve 56 is secured to a cross-bracing member of the platform. Alternatively, the lower end of the anode carrier section 27, below the sleeve 56 could be provided with a suitable stop or other stop means 58 so that the sleeve 56 would not drop off the anode carrier section 27.

Alternatively, prior to or simultaneously with the installation of the present anode carrier apparatus in a platform, a bell cone guide and connector 60 (FIG. 14) could be installed on the lowermost cross-bracing member of the platform which the anode carrier apparatus was to reach. Thus, the bell cone guide 60 having a suitable clamp 61 secured thereto could be lowered through the water to the desired cross-bracing member where it would be attached by divers or underwater vehicle. When the lower end of the lowermost anode carrier section 27 was lowered into it, it would serve as a connector to the platform against a lateral movement of the section 27. Alternatively, the bell cone guide 60 could be secured to the lower end of section 27 by means of a shear pin 62 or set screw 63 and lowered into place on the platform where a diver would attach clamp to a cross-bracing member. Shearing of the shear pin would permit relative axial movement of the anode carrier section 27 within the cone 60 thus allowing the hanger 41*b* near the upper end of the anode carrier section to be hung on a higher cross-bracing member. Adjustment of set screw 63 would then anchor the section 27 against vertical movement and give good electrical contact between the lower end of the section 27 and the cross-bracing member 12. While the drawing has been described with regard to using only one set screw in places to lock the anode carrier sections 27 together against vertical movement, it is to be understood that several set screws may be used as shown in FIGS. 5 and 16.

Figure 15:
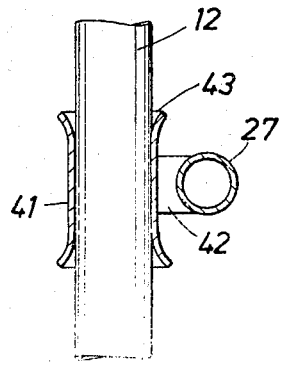
FIG. 15 is a bottom view of a hanger being formed with means for guiding the hanger to its seated position on a lateral cross-bracing member of the platform substructure.

In the event that the anode carrier apparatus is to installed underwater without the use of divers, it may be desired to use orienting means carried by the anode carrier sections 27 so that the hanger carried by one anode carrier section is turned in the right direction when it is stabbed into a lower section, so that the hanger is in a position to seat on or engage a cross-bracing member of the platform. The oriented means would take the form of two cooperating elements one of which is carried at one end of a carrier section and the other being carried by the adjacent end of the carrier section end to which it is being connected. For example, as shown in FIG. 13, an orienting shoulder 64 would be formed on the inner wall at the upper end of the anode carrier section 27 to cooperate with an aligning pin such as pin 62 (FIG. 14) which would extend outwardly from the tubular section and engage the shoulder so that the entire section would be rotated upon axial movement of the pin relative to the shoulder. Thus, axial movement of the two portions in contact with each other causes the upper anode carrier section to be rotated relative to the lower section to a predetermined azimuth which would be that at which the hanger was located above a cross-bracing member upon which it was to be seated. Further, as shown in FIG. 15, it may be desirable to open up the outer ends of the saddle elements of the hanger on or the lower portion thereof to provide orienting means by which a saddle element 43 may be more readily seated upon a cross-bracing member 12.

Figure 11:
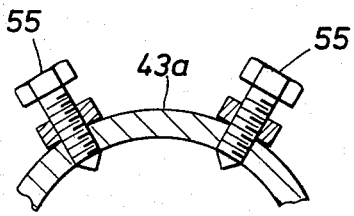
FIGS. 11 and 12 are partial sectional views of an anode hanger illustrating different forms of electrical contact elements for engaging a cross-bracing member of a platform substructure.

While the use of set screws 55 (FIG. 5 and FIG. 11) and the use of cone shaped contacts 54 (FIG. 12) has been illustrated as means for providing electrical contact between the hangers of the anode carrier sections and the cross-bracing members of the platform, it is realized that the cross-bracing members 12 (FIG. 4) of the platfrom may be connected electrically by means of a cable 65 to any portion of the anode carrier sections 27. Additionally, the anode carrier sections 27 may be provided with one or more pad eyes 66 for lowering a section down through the water to its installed position. Each anode carrier section is also provided with transverse internal walls 33 and 34 which are set back from the ends thereof so as to form a chamber therebetween to give buoyancy to the section and to stiffen the section at that point. The spacing between the walls 33 and 34 is adjusted so that the section has a substantially neutral buoyancy when the anodes 30 secured to the outer surface of the section have been consumed.

In the diagrammatic cross-sectional view of FIG. 10, one arrangement of anodes 30 is shown as located around the pipe section 28 90 degrees from each other. The anodes 70 shown in phantom to one side of each of the anodes 30 would be the placement of the next lower row of anodes around the pipe section 28.

Thus, by use of the apparatus described hereinabove, the present invention provides a method for adding anodes to an offshore platform that is provided with a series of lateral cross-bracing members between the legs of the platform at a plurality of vertically spaced levels within the platform or platform substructure, that is, that portion of the platform below the deck. Although new platforms may be designed that are equipped to add additional anodes when the original anodes have been consumed, here are hundreds of platforms in the Gulf of Mexico and off the Pacific Coast that have no means of adding additional anodes to protect the platform substructure or the well conductors that extend therethrough and into the ocean floor.

In practicing the present method, a plurality of anodes of selected materials are first fixedly secured and electrically connected to each of a series of elongated tubular anode carrier sections, preferably, rigid lengths of pipe. Depending upon the depth of water in which the platform is placed and the number of well conductors or other elements of the platform to be protected, a series or a preselected number of these anode carrier sections are connected together underwater and then mechanically secured in a weight-supporting manner to the substructure of the platform as well as being electrically connected thereto. According to the present invention, the method may be carried out from the desk of the platform through a hole therein that is positioned adjacent the well conductors to be protected. Alternatively, operations could be carried out below the deck using a narrow-beamed barge to move between the legs of the platform to a position adjacent the well conductors where the anode carrier sections of the present invention are to be lowered down through the water.

In carrying out the present method of forming along anode carrier apparatus within the platform, a first anode carrier section 27 (FIG. 3) is lowered through the water and through the platform substructure to a preselected lateral cross-bracing member of said platform structure at the deepest water location where anodes are to be added. The anode carrier section 27 is then moved laterally so that the hanger elements **41*b* and 41*d* are positioned over two vertically-spaced cross-bracing members 12 of the substructure. Continued lowering of the anode carrier section 27 by means of cables attached to pad eye 66 on each side of the section allows the hanger elements 41*b* and 41*d* to seat on the cross-bracing members 12 and for the arms 45 to move to the vertical position illustrated. If desired, the arm 45 can be locked into this position by means of the rod 48 (FIG. 5) being connected by nut 50. Prior to setting the hanger elements on the cross-bracing members, any corrosion or marine growth is preferably removed from the seating area by an underwater vehicle remotely operated or by a diver, if the water is not too deep. If the spacing between the hanger elements 41*b* and 41*d* is greater than the spacing between the cross-bracing member 12, the lower hanger element 41*d* will be seated first and upon continued lowering the shear pin 57 will be sheared so that the tubular body member 28 will move downwardly relative to the sleeve 56 until the upper hanger element 41*b* has seated itself. Additional sections similar to the one shown in FIG. 4 are then lowered one at a time through the water to a position that is in substantial axial alignment with the next lower anode carrier section which has already been attached to the platform. The smaller diameter section 28*a* of the anode carrier section is then stabbed into the bell guide 36 and into the top of the larger diameter upper section of the larger section 28 of the anode carrier section 27. Continued lowering of the section shown in FIG. 4 is carried out until the hanger element 41 is seated on the cross-bracing member 12**.

Figure 12:
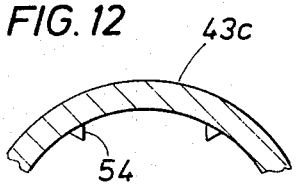

When all of the sections 27 of the anode carrier apparatus 25 of FIG. 1 have been connected together as illustrated, each of the sections 27 is electrically connected to the cross-bracing member 12 that it hangs from either by cable 65 (FIG. 4) or by set screws 55 (FIG. 11), which may be adjusted as needed, or by use of the cone shaped contacts 54 (FIG. 12). The final assembly of the anode carrier apparatus 25 may extend from the surface of the water 14 (FIG. 1), or from a point thereabove, to a position near the ocean floor 13, as illustrated. Preferably, the upper end of the anode carrier apparatus is located at least 20 feet below the water level to get it out of the wave action and thus reduce the forces acting against it and against the platform. However, it is to be understood that the anode carrier apparatus may be of any length and may span any portion of the platform which needs added protection against corrosion. The use of latched or unlatched hangers is a matter of choice.

After the anodes have been added to the platform in a manner taught by the present invention, the current being produced by the anodes is measured by any suitable method, as by using an inductive coil pick-up meter, in a manner well known to the art. After waiting for a predetermined period for the platform and the well conductors mounted therein to become polarized, which period may be up to six months or more, the cathode potential of the platform is then measured to determine the level of protecting against corrosion that is being achieved by the anode system now on the platform. If it is determined that the cathode potential of the platform and hence the level of protection thereof is not adequate, an engineering study is made to determine the location and level at which additional anodes are needed in the platform. Additional anodes may then be added by the method described hereinabove until it is considered that the platform is adequately protected.

We claim as our invention:

1. A method of providing anodes for a platform that is in position at an offshore location, said platform being formed of a plurality of substantially vertical legs, lateral cross-bracing members between the legs at a plurality of vertically-spaced levels within the platform to form a platform substructure, and at least one deck supported by said legs above the water level, said platform being equipped with a plurality tubular elongated well conductors extending through the platform and the water beneath it and into the ocean floor below the mudline, said platform and well conductors being of a corrodible metal, said method comprising:

securing and electrically connecting at least one anode to an elongated tubular anode carrier section, assembling a plurality of said anode carrier sections at the platform at its offshore location, continually forming a long anode apparatus underwater by lowering a first anode carrier section in the water through the platform substructure to a pre-selected lateral cross-bracing member of said platform substructure at the deepest water location where anodes are to be added, connecting at least one pre-selected point of said first anode carrier section to said pre-selected cross-bracing member of said platform substructure against lateral movement and in weight-supporting engagement therewith, electrically connecting said first anode carrier section to the platform substructure, successively lowering additional anode carrier sections one at a time through the water to a position that is in axial alignment with said next lower anode carrier section, operatively engaging underwater the lower end of each added anode carrier section to the upper end of the lower anode carrier section, connecting at least one pre-selected point of each newly-positioned higher anode carrier section to an adjacent cross-bracing member of said platform substructure prior to lowering the next to-be-added anode carrier section, and electrically-connecting each of said anode carrier sections to said platform substructure.

2. The method of claim 1 wherein the step of connecting the first anode carrier section includes the steps of making a connection between a lower cross-bracing member and a lower connecting point near the lower part of said anode carrier section, adjusting the spacing between said lower connection point and an upper connection point to the spacing between said lower cross-bracing member and the next higher cross-bracing member and, connecting said upper connection point adjacent the upper end of said first anode carrier section to said next higher cross-bracing member.

3. The method of claim 1 wherein the step of connecting the first anode carrier section to said platform substructure comprises making simultaneous connections near the upper and lower ends of said anode carrier section with upper and lower vertically-spaced cross-bracing members of said platform substructure.

4. The method of claim 1 wherein, prior to connecting each anode carrier section to said platform substructure, said anode carrier section is rotated about a vertical axis to an azimuth at which the upper connection point thereof is adjacent the cross-bracing member of the platform substructure to which it is to be connected.

5. The method of claim 1 wherein the connection of an anode carrier section to a selected cross-bracing member of the platform substructure includes the step of hanging said anode carrier section from the cross-bracing member.

6. The method of claim 5 including the step of providing each of said anode carrier members in the upper half thereof with hanger means for engagement with a selected cross-bracing member.

7. The method of claim 6 including the step of providing connector means including an opening at the upper end of each anode carrier section, and vertically stabbing the lower end of the next higher anode carrier section telescopingly into said opening at the upper end of said adjacent anode carrier section to prevent relative lateral movement of the stabbed sections.

8. The method of claim 7 including the steps of lowering the lower end of an upper anode carrier section into the opening at the top of said lower anode carrier section while simultaneously lowering said hanger means carried by said anode carrier section into weight-supporting seating engagement on the adjacent cross-bracing member of the platform substructure.

9. The method of claim 8 including the step of fixedly latching each of said hanger means to adjacent cross-bracing members to prevent relative vertical movement therewith.

10. The method of claim 9 including the step of locking together adjacent connecting ends of adjacent anode carrier members to prevent relative vertical movement therebetween.

11. The method of claim 1 including the step of buoyantly supporting a portion of the weight of each of said anode carrier sections with the remainder of the weight being supported by the platform substructure.

12. The method of claim 11 including the step of providing each anode carrier section with buoyancy sufficient to maintain said anode carrier section at substantially neutral buoyancy when the weight of the anodes secured to said anode carrier section has been consumed.

13. The method of claim 1 including the subsequent steps of allowing the platform with its newly-added anodes to become polarized, and at the end of a predetermined time period measuring the cathode potential of the platform to determine the level of protection against corrosion being achieved by the anodes.

14. The method of claim 13 including the steps of determining the location and level at which additional anodes are needed in the platform and repeating the steps of claim 1 to add anodes to the platform.

15. For use with a platform that is in position at an offshore location, said platform being formed of a plurality of substantially vertical legs, lateral cross-bracing members between the legs at a plurality of vertically-spaced levels within the platform forming a platform substructure and at least one deck supported by said legs above the water level, said platform being equipped with a plurality of tubular elongated well conductors extending through the platform and the water beneath it and into the ocean floor below the mudline, said platform and well conductors being of a corrodible metal, a corrosion-inhibiting long anode apparatus adapted to be installed on the offshore platform, said apparatus comprising:

an elongated tubular anode carrier apparatus made up of a plurality of shorter tubular anode carrier sections, at least one anode fixedly secured and electrically connected to each anode carrier section, said anode carrier sections being operatively connected together against lateral movement in end-to-end telescoping relationship while being suspended vertically in said platform at a point selected in the vicinity of the well conductors, hanger means fixedly secured to each of said anode carrier sections near the upper end thereof and being adapted to seat on at least one lateral cross-bracing member of said platform at least at an underwater location, for suspending the anode carrier section vertically within said platform in the vicinity of the well conductors thereof, and electrical connector means operatively arranged carried between each of said anode carrier sections and a member of said platform substructure for forming electrical connections with the platform.

16. The apparatus of claim 15 including first connector means carried by at least one end of one of each pair of anode carrier sections, adapted to be mounted in end-to-end relationship, for anchoring the connected ends against lateral movement relative to each other.

17. The apparatus of claim 14 including anchoring means carried by at least one of said connectable ends of two adjacent anode carrier sections for anchoring said sections against relative axial vertical movement.

18. The apparatus of claim 14 wherein the anode carrier sections are of tubular construction and the first connector means between adjacent anode carrier sections comprises a recess formed by the open end of one section and being of a diameter to telescopingly receive therein the cooperating end of the adjacent section to which it is connected.

19. The apparatus of claim 16 including aligning means carried by at least one end of one of each pair of anode carrier sections, whereby the co-operating ends of said pair of sections are guided into axial alignment with each other.

20. The apparatus of claim 19 wherein the anode carrier sections are tubular and open-ended and said aligning means comprises a truncated cone bell guide with the top of the cone being fixedly secured to the open end of one of said anode carrier sections for guiding the cooperating end of said adjacent anode carrier section into axial alignment therewith.

21. The apparatus of claim 20 wherein a bell guide aligning means is affixed to the upper end of each anode carrier section, when positioned vertically.

22. The apparatus of claim 19 wherein the anode carrier sections are tubular in construction, the end of one of a pair of anode carrier sections being open ended, said aligning means comprising stab-type tapered aligning means carried by the co-operating end of the adjacent anode carrier section, said tapered aligning means being of a size to enter and seat within the open end of the adjacent carrier section to guide the two sections into axial alignment.

23. The apparatus of claim 16 including second connector means carried adjacent the lower end of the lowermost anode carrier section of said anode carrier apparatus, said second connector means being of a size to engage a cross-bracing member of the platform substructure and anchor the lower end of the anode carrier apparatus against lateral movement.

24. The apparatus of claim 23 wherein the second connector means comprises a sleeve element slidably mounted adjacent the lower end of the lowermost anode carrier section, stop means engaging said sleeve element to prevent it dropping off the anode carrier section as the section is run down through the water to a position in the platform substructure, and clamp means secured to said sleeve element and being adapted to seat on a cross-bracing member of said platform substructure for anchoring said sleeve element against lateral displacement.

25. The apparatus of claim 17 including pin anchoring means carried adjacent one end of one of a pair of cooperation anode carrier sections and engagable with the other cooperating section to lock the sections together and prevent axial movement therebetween.

26. The apparatus of claim 24 including second anchoring means carried by said sleeve element for engaging said anode carrier section and locking it against relative axial movement therebetween.

27. The apparatus of claim 15 wherein each of said hanger means comprises, when viewed in a vertical assembled position, a horizontal pipe-engaging saddle element of a size and configuration to rest upon and cooperate with at least the upper surface of a cross-bracing member of said platform substructure, and support means fixedly securing said horizontal saddle element to an anode carrier section in the upper portion thereof and at an offset position thereto, said offset distance of the longitudinal axis of the saddle element being equal to at least the diameter of the platform cross-bracing member on which the saddle element contacts.

28. The apparatus of claim 27 wherein the spacing between the several hanger means along the length of said anode carrier apparatus is substantially equal to the vertical spacing between the cross-bracing members of the platform substructure on which the hanger means rest.

29. The apparatus of claim 27 wherein the pipe-engaging saddle element is a short half-section of pipe that has been cut longitudinally into two half sections, the inner diameter of the pipe forming the saddle element being at least equal to that of the outer diameter of the cross-bracing member on which it is to rest, the inner edge of the saddle element being secured to the support means connected to the anode carrier means, hinge means carried on the outer edge of the saddle element, and a hinge plate connected to and forming a part of said hinge means, said hinge plate being adapted to be moved to a position against the lower half of a cross-bracing member of the platform substructure which is adapted to contact.

30. The apparatus of claim 29 wherein the hinge plate is concave along its horizontal length to a diameter to mate with a portion of the lower half of the cross-bracing member.

31. The apparatus of claim 29 including latch means for locking each hinge plate against a cross-bracing member of said platform substructure.

32. The apparatus of claim 31 wherein the latch means comprises at least one connecting rod of a length to extend from and be secured between said free end of said hinge plate to the support means of said pipe-engaging saddle element.

33. The apparatus of claim 15 wherein said electrical connector means comprises an electrical cable operatively connected at one end to an anode carrier section and at the other end to a member of said platform substructure.

34. The apparatus of claim 15 wherein said electrical connector means comprises a plurality of contact elements extending outwardly from the surface of the hanger means in contact with the surface of a cross-bracing member of said platform substructure.

35. The apparatus of claim 15 including wall means secured within each tubular anode carrier section near the ends thereof to form a chamber therebetween to give buoyancy to the section, the spacing between said wall means being adjusted so that the section has substantially neutral buoyancy when the anodes secured to the outer surface of the section have been consumed.

36. The apparatus of claim 16 including orienting means having two cooperating portions connected to adjacent ends of each pair of anode carrier sections, one portion of the orienting means being affixed to the upper end of each anode carrier section, the other portion of the orienting means being affixed to the lower end of each anode carrier section, whereby axial movement of the two portions in contact with each other causes the upper anode carrier section to rotate relative to the lower section to a predetermined azimuth.

* * * * *